US011118462B2

(12) United States Patent
Paradis et al.

(10) Patent No.: US 11,118,462 B2
(45) Date of Patent: Sep. 14, 2021

(54) BLADE TIP POCKET RIB

(71) Applicant: PRATT & WHITNEY CANADA CORP., Longueuil (CA)

(72) Inventors: Vincent Paradis, Longueuil (CA); Othmane Leghzaouni, Brossard (CA); Masoud Roshan Fekr, Saint-Lambert (CA); Marc-Antoine Mailloux-Labrousse, Montreal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 183 days.

(21) Appl. No.: 16/256,166

(22) Filed: Jan. 24, 2019

(65) Prior Publication Data

US 2020/0240274 A1 Jul. 30, 2020

(51) Int. Cl.
*F01D 5/18* (2006.01)

(52) U.S. Cl.
CPC ..... *F01D 5/187* (2013.01); *F05D 2220/32* (2013.01); *F05D 2260/20* (2013.01)

(58) Field of Classification Search
CPC ..... F01D 5/187; F01D 5/186; F01D 9/041; F01D 5/20; F05D 2240/301; F05D 2260/202; F05D 2250/323; F05D 2260/607; F05D 2240/307
See application file for complete search history.

(56) References Cited

U.S. PATENT DOCUMENTS 3,635,585 A * 1/1972 Metzler, Jr. ..... F01D 5/187 416/96 R
3,781,129 A * 12/1973 Aspinwall ..... F01D 5/189 416/97 R
4,010,531 A * 3/1977 Andersen ..... B23P 15/04 29/889.721
4,142,824 A * 3/1979 Andersen ..... F01D 5/187 415/115
4,390,320 A * 6/1983 Eiswerth ..... F01D 5/005 29/889.1
4,411,597 A * 10/1983 Koffel ..... B23P 6/005 416/92
4,424,001 A * 1/1984 North ..... F01D 5/20 416/92
4,606,701 A * 8/1986 McClay ..... F01D 5/187 416/92

(Continued)

FOREIGN PATENT DOCUMENTS

CN 102128055 7/2011
CN 207048823 2/2018

(Continued)

*Primary Examiner* — Woody A Lee, Jr.
*Assistant Examiner* — Brian Christopher Delrue
(74) *Attorney, Agent, or Firm* — Norton Rose Fulbright Canada LLP

(57) ABSTRACT

A turbine blade for a gas turbine engine, the turbine blade having a peripheral blade tip wall surrounding a radially recessed tip pocket, the peripheral blade tip wall having: a wall height; a leading edge; a trailing edge; a pressure side wall; and a suction side wall; and a rib extending between the pressure side wall and the suction side wall defining a leading portion and a trailing portion of the radially recessed tip pocket, the rib having a rib height less than the wall height.

10 Claims, 5 Drawing Sheets

(56) References Cited

U.S. PATENT DOCUMENTS 4,893,987 A * 1/1990 Lee ..... F01D 5/187 416/92
5,120,192 A 6/1992 Ueda et al.
5,660,523 A * 8/1997 Lee ..... F01D 5/20 416/97 R
5,733,102 A * 3/1998 Lee ..... F01D 5/20 416/97 R
6,039,531 A * 3/2000 Suenaga ..... F01D 5/186 415/115
6,059,530 A * 5/2000 Lee ..... F01D 5/145 416/96 A
6,086,328 A * 7/2000 Lee ..... F01D 5/18 415/115
6,164,914 A * 12/2000 Correia ..... F01D 5/187 416/97 R
6,224,336 B1 * 5/2001 Kercher ..... F01D 5/186 415/115
6,527,514 B2 * 3/2003 Roeloffs ..... F01D 5/186 416/97 R
6,554,575 B2 * 4/2003 Leeke ..... F01D 5/20 416/224
6,595,749 B2 * 7/2003 Lee ..... B23P 6/005 415/173.1
6,652,235 B1 * 11/2003 Keith ..... F01D 5/141 416/92
6,672,829 B1 * 1/2004 Cherry ..... F01D 5/141 415/115
6,790,005 B2 * 9/2004 Lee ..... F01D 5/187 416/97 R
6,970,005 B2 11/2005 Rincon et al.
7,258,528 B2 8/2007 Trindade et al.
7,458,780 B2 12/2008 Weisse et al.
7,473,073 B1 1/2009 Liang
7,513,743 B2 * 4/2009 Liang ..... F01D 5/20 415/173.6
7,704,045 B1 4/2010 Liang
7,704,047 B2 4/2010 Liang et al.
7,845,905 B2 12/2010 Ahmad et al.
7,875,908 B2 1/2011 Adam et al.
7,922,451 B1 * 4/2011 Liang ..... F01D 5/20 416/97 R
7,967,563 B1 6/2011 Liang
7,997,865 B1 * 8/2011 Liang ..... F01D 5/20 416/92
8,011,889 B1 * 9/2011 Liang ..... F01D 5/20 416/97 R
8,043,058 B1 10/2011 Liang
8,047,789 B1 11/2011 Liang
8,061,987 B1 11/2011 Liang
8,083,484 B2 * 12/2011 Hatman ..... F01D 5/20 416/92
8,096,768 B1 1/2012 Liang
8,113,779 B1 2/2012 Liang
8,157,504 B2 * 4/2012 Amaral ..... F01D 5/20 415/115
8,231,349 B2 7/2012 Naik et al.
8,251,660 B1 8/2012 Liang
8,337,158 B1 * 12/2012 Liang ..... F01D 5/20 416/97 R
8,435,004 B1 * 5/2013 Liang ..... F01D 5/187 416/97 R
8,439,643 B2 * 5/2013 Kuhne ..... F01D 5/20 416/193 A
8,469,666 B1 6/2013 Liang
8,632,311 B2 * 1/2014 Klasing ..... F01D 5/20 416/228
8,647,071 B2 * 2/2014 Pons ..... F01D 5/20 416/228
8,740,567 B2 6/2014 Suciu et al.
8,777,572 B2 * 7/2014 Cheong ..... F01D 5/20 416/97 R
8,801,379 B2 8/2014 Allen et al.
9,057,276 B2 * 6/2015 Lee ..... F01D 5/187
9,115,590 B2 8/2015 Spangler et al.
9,120,144 B2 * 9/2015 Lee ..... F01D 5/187
9,188,012 B2 11/2015 Lacy et al.
9,297,262 B2 3/2016 Zhang et al.
9,334,742 B2 * 5/2016 Zhang ..... F01D 5/20
9,593,584 B2 * 3/2017 Lehmann ..... F01D 5/141
9,670,936 B2 6/2017 Cortequisse
9,726,024 B2 * 8/2017 Buhler ..... F01D 9/02
9,810,074 B2 * 11/2017 Lee ..... F01D 5/20
9,856,739 B2 * 1/2018 Bedrosyan ..... F01D 5/187
9,863,254 B2 1/2018 Ceglio et al.
9,896,943 B2 * 2/2018 Crosatti ..... B22F 5/009
9,951,642 B2 4/2018 Bogue
9,995,148 B2 6/2018 Molter et al.
10,012,089 B2 * 7/2018 Quach ..... F01D 5/147
10,053,989 B2 8/2018 Weber et al.
10,077,680 B2 9/2018 Thibodeau et al.
10,107,108 B2 * 10/2018 Jones ..... F02C 3/04
10,174,620 B2 1/2019 Krumanaker et al.
10,184,342 B2 1/2019 Zhang et al.
10,190,418 B2 * 1/2019 Kwon ..... F01D 11/08
10,253,637 B2 * 4/2019 Schroeder ..... F01D 5/141
10,287,900 B2 5/2019 Slavens et al.
10,301,943 B2 5/2019 Brittingham
10,301,945 B2 5/2019 Chouhan et al.
10,350,684 B2 * 7/2019 Bunker ..... B22F 7/08
10,487,664 B2 * 11/2019 Bunker ..... B22F 7/08
10,677,066 B2 * 6/2020 Lewis ..... F04D 29/681
2002/0094268 A1 * 7/2002 Sugishita ..... F01D 9/04 415/139
2002/0119045 A1 * 8/2002 Starkweather ..... F01D 5/187 416/97 R
2003/0021684 A1 * 1/2003 Downs ..... F01D 5/145 416/92
2003/0059304 A1 * 3/2003 Leeke ..... F01D 5/20 416/97 R
2003/0170120 A1 * 9/2003 Grunke ..... F01D 5/20 415/174.4
2004/0126236 A1 * 7/2004 Lee ..... F01D 5/187 416/97 R
2005/0244270 A1 * 11/2005 Liang ..... F01D 5/18 416/97 R
2006/0062671 A1 * 3/2006 Lee ..... F01D 5/20 416/92
2006/0171809 A1 * 8/2006 Albrecht ..... F01D 5/18 416/97 R
2008/0044289 A1 * 2/2008 Klasing ..... F01D 5/20 416/235
2008/0044290 A1 * 2/2008 Klasing ..... F01D 5/187 416/235
2010/0111704 A1 * 5/2010 Hada ..... F01D 5/20 416/97 R
2010/0221122 A1 * 9/2010 Klasing ..... F01D 5/20 416/97 R
2010/0232979 A1 * 9/2010 Paauwe ..... F01D 5/20 416/97 R
2011/0044818 A1 * 2/2011 Kuhne ..... F01D 5/20 416/212 A
2013/0039773 A1 * 2/2013 Funk ..... F01D 25/24 416/223 R
2013/0266454 A1 * 10/2013 Mongillo, Jr. ..... F01D 5/20 416/97 R
2014/0030101 A1 * 1/2014 Mishra ..... F01D 5/20 416/223 R
2014/0030102 A1 * 1/2014 Mishra ..... F01D 5/20 416/223 R
2014/0047842 A1 * 2/2014 Chlus ..... F01D 5/20 60/726
2015/0330228 A1 * 11/2015 Quach ..... F01D 5/186 416/95
2016/0052621 A1 * 2/2016 Ireland ..... F04D 29/684 137/13
2016/0208621 A1 7/2016 Spangler et al.
2016/0341046 A1 * 11/2016 Feldmann ..... F01D 5/187
2016/0369634 A1 * 12/2016 Slavens ..... F01D 5/187
2017/0089207 A1 * 3/2017 Marsh ..... F01D 5/188
2017/0107825 A1 4/2017 Krumanaker et al.

(56) References Cited

U.S. PATENT DOCUMENTS

| | | | | |
|---|---|---|---|---|
| 2017/0145833 | A1 | 5/2017 | Thornton | |
| 2017/0167275 | A1* | 6/2017 | Schroeder | F01D 5/20 |
| 2017/0226868 | A1* | 8/2017 | Martinello | F01D 5/186 |
| 2017/0335691 | A1* | 11/2017 | Crites | F01D 9/065 |
| 2018/0066524 | A1 | 3/2018 | LoRicco et al. | |
| 2018/0156042 | A1* | 6/2018 | Mongillo, Jr. | F01D 5/20 |
| 2018/0156049 | A1* | 6/2018 | Clum | F01D 9/041 |
| 2018/0202295 | A1* | 7/2018 | Rhodes | F01D 5/187 |
| 2018/0274373 | A1* | 9/2018 | Quach | F01D 5/20 |
| 2019/0136699 | A1* | 5/2019 | Spangler | F02C 7/18 |
| 2019/0169999 | A1* | 6/2019 | Rathay | F01D 5/20 |
| 2019/0186273 | A1* | 6/2019 | Halfmann | F01D 5/187 |

FOREIGN PATENT DOCUMENTS

| | | | | | |
|---|---|---|---|---|---|
| EP | 0340149 | A1 * | 11/1989 | | F01D 5/187 |
| EP | 1362982 | A1 * | 11/2003 | | F01D 5/186 |
| EP | 2666968 | | 11/2013 | | |
| EP | 3042040 | | 3/2019 | | |
| EP | 3460190 | | 3/2019 | | |
| EP | 3498975 | A1 * | 6/2019 | | F01D 5/187 |
| GB | 1188401 | A * | 4/1970 | | F01D 5/187 |
| GB | 2382383 | A * | 5/2003 | | F01D 5/187 |
| GB | 2402715 | A * | 12/2004 | | F01D 5/186 |
| JP | 2008128247 | | 6/2008 | | |
| WO | WO-0019065 | A1 * | 4/2000 | | B22D 31/002 |
| WO | WO-2005068783 | A1 * | 7/2005 | | F01D 5/187 |
| WO | WO-2005095761 | A1 * | 10/2005 | | F01D 5/187 |
| WO | WO-2016076834 | A1 * | 5/2016 | | F01D 5/187 |
| WO | WO2017/119898 | A1 | 7/2017 | | |
| WO | WO-2018143997 | A1 * | 8/2018 | | F01D 5/20 |

* cited by examiner

BLADE TIP POCKET RIB

TECHNICAL FIELD

The disclosure relates generally to gas turbine engines, and more particularly to turbine blades having a tip pocket.

BACKGROUND

Turbine blades used in gas turbine engines and other turbines have a radially outward blade tip that rotates at high speed relative to a peripheral shroud defining the engine gas path. Maintaining a minimal gap between the blade tip and shroud serves to improve engine efficiency.

Turbine blade tips of an internally cooled turbine blade are cooled with cooling air exhausted through openings in the tip. The turbine blade tips are exposed to high gas temperature and mechanical forces imposed by the high rotation speed. Thermo-mechanical fatigue life of the airfoil and blade tips in particular can determine the repair cycle of an engine which may involve removal and replacement of turbine blades. Improvement is desirable to reduce the costs and delays involved with engine downtime caused by thermo-mechanical fatigue of turbine blade tips.

SUMMARY

In one aspect, the disclosure describes a turbine blade for a gas turbine engine, the turbine blade having a peripheral blade tip wall surrounding a radially recessed tip pocket, the peripheral blade tip wall having: a wall height; a leading edge; a trailing edge; a pressure side wall; and a suction side wall; and a rib extending between the pressure side wall and the suction side wall defining a leading portion and a trailing portion of the radially recessed tip pocket, the rib having a rib height less than the wall height. Embodiments can include combinations of the above features.

Further details of these and other aspects of the subject matter of this application will be apparent from the detailed description included below and the drawings.

DETAILED DESCRIPTION

Figure 1:
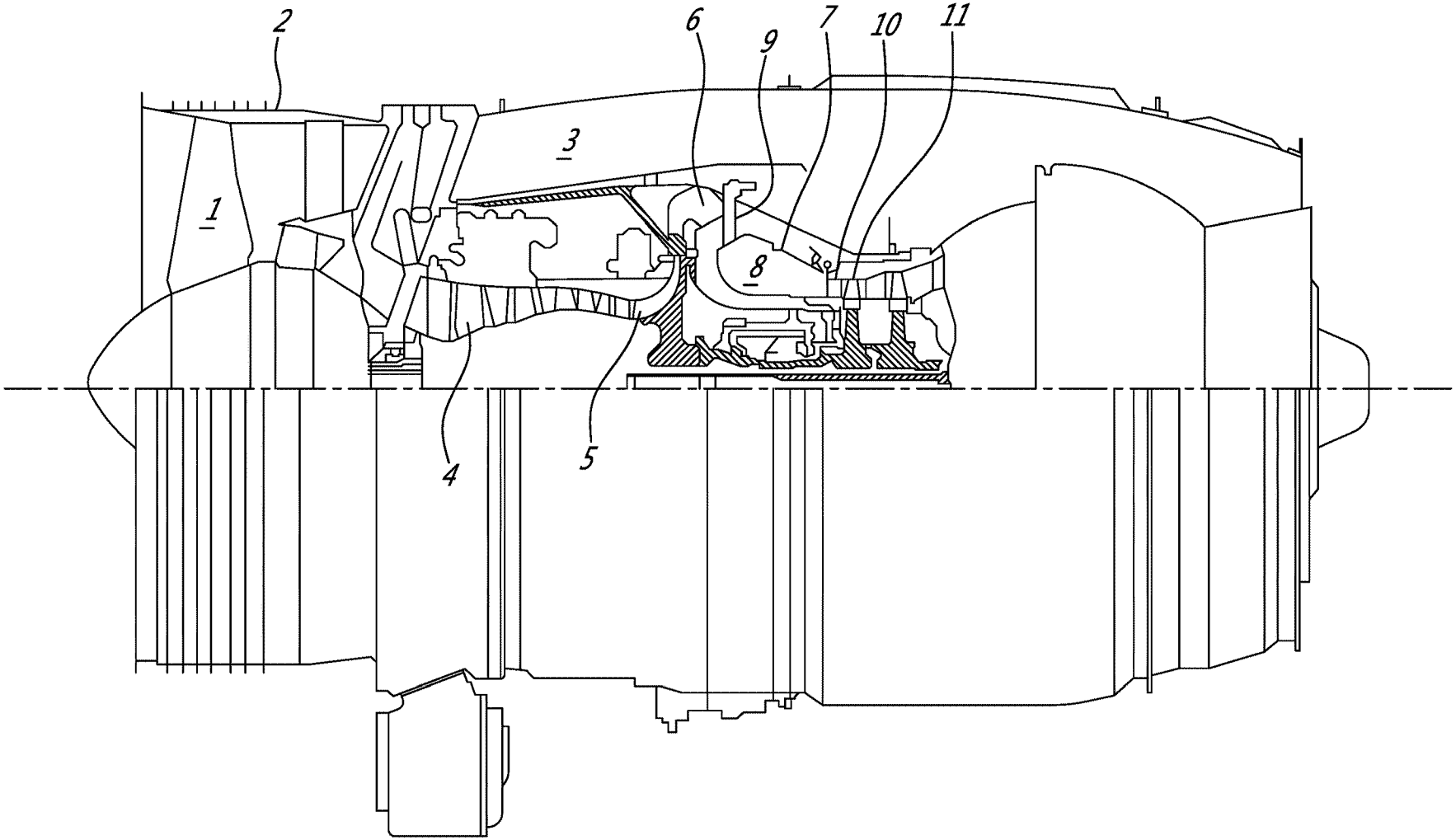
FIG. 1 shows an axial cross-section view of a turbo-fan gas turbine engine.

FIG. 1 shows an axial cross-section through an example of turbo-fan gas turbine engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 and fuel is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust. A portion of the cooling air created in the compressor 5 is used for internal cooling of the turbines 11.

Figure 3:
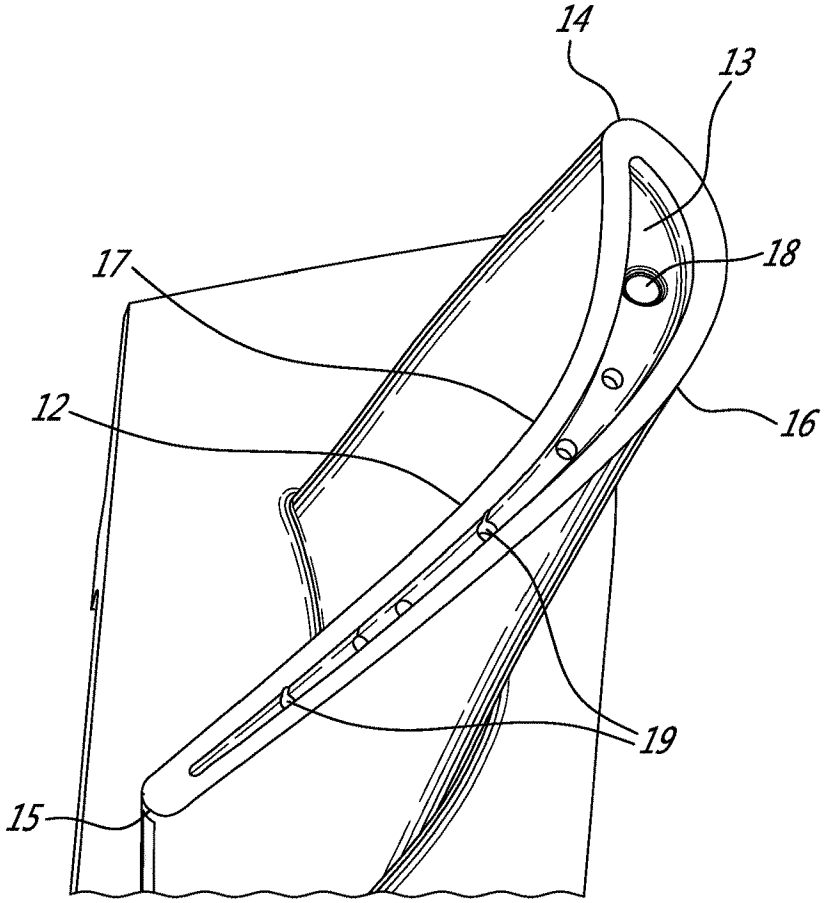
FIG. 3 is a radially inward view of a second example a turbine blade tip with a full tip pocket extending from a leading edge to a trailing edge.
Figure 2:
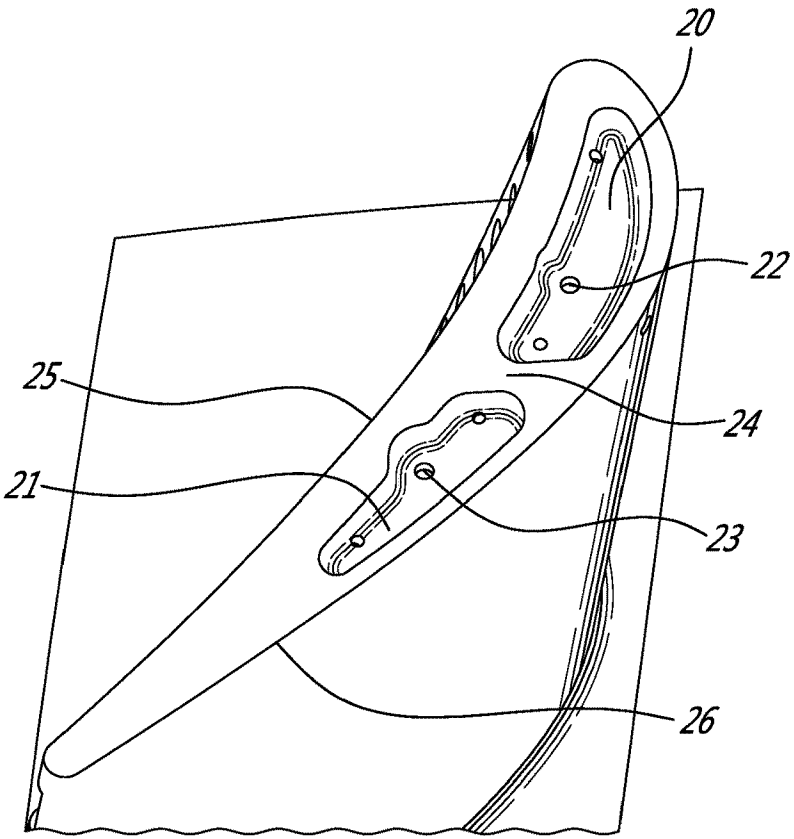
FIG. 2 is a radially inward view of a first example turbine blade tip with two tip pockets divided by a full height rib.

Turbines 11 have a central hub and a peripheral array of replaceable turbine blades. FIGS. 2 and 3 show the radially outward tips of such turbine blades. FIG. 3 shows a peripheral blade tip wall 12 surrounding a single full length radially recessed tip pocket 13. The peripheral blade tip wall 12 has a wall height, a leading edge 14, a trailing edge 15, a suction side wall 16, and a pressure side wall 17. The example of FIG. 3 has a relatively large leading opening 18 and a series of smaller openings 19 leading toward the trailing edge 15. The openings 18, 19 communicate with the internal cooling channels of the turbine blade that are supplied with pressurized cooling air to cool the blade tip and the peripheral blade tip wall 12 in particular which is exposed to hot gas and mechanical stress during high speed operation.

FIG. 2 shows another example with two separate tip pockets 20, 21 also supplied with cooling air via openings 22, 23. The tip pockets 20, 21 are separated by an intermediate wall 24 that joins the pressure side wall 25 and the suction side wall 26.

Figure 4:
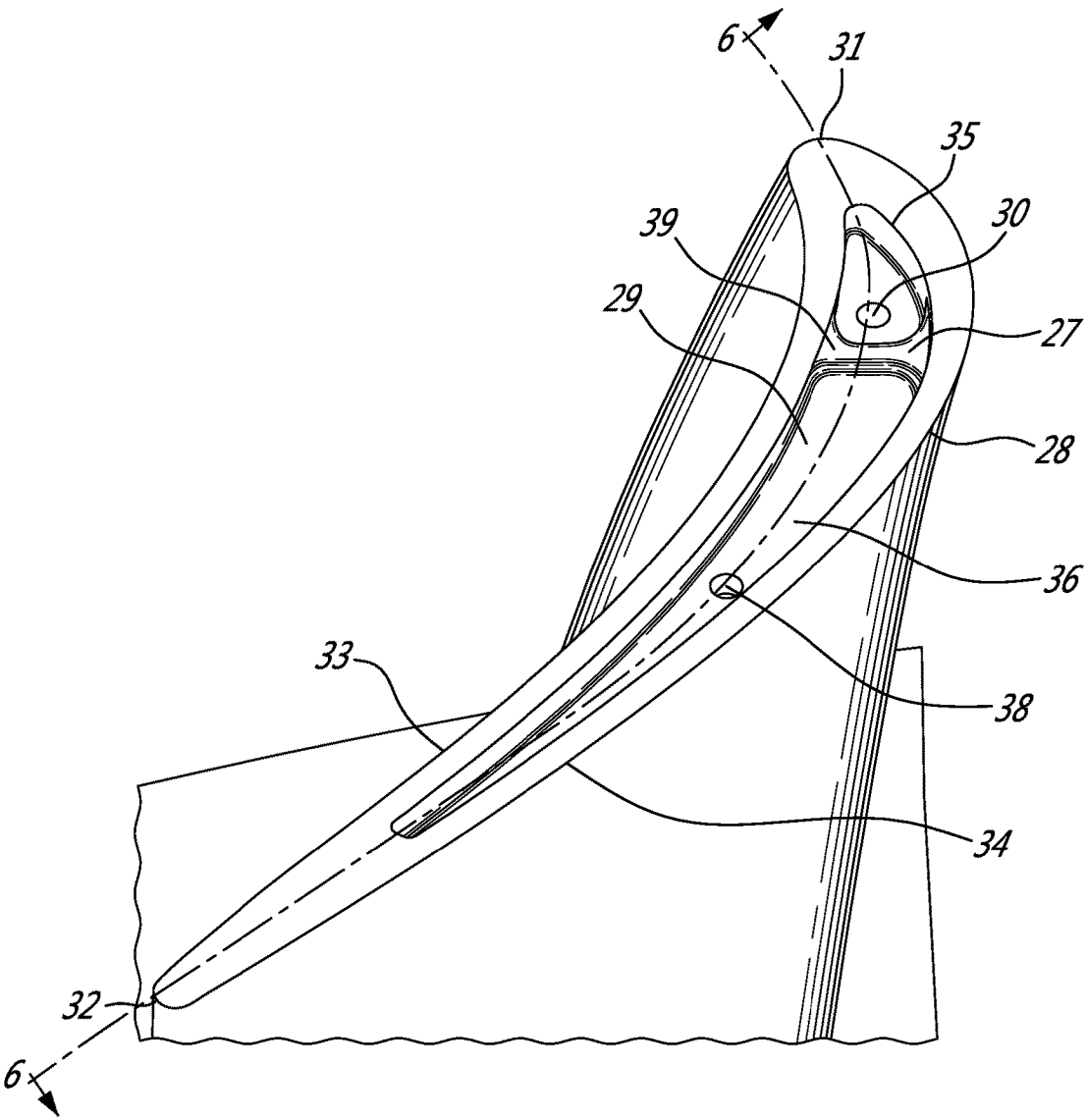
FIG. 4 is a radially inward view of an example turbine blade tip in accordance with the present description with a tip pocket divided by a partial height rib into leading and trailing portions.
Figure 5:
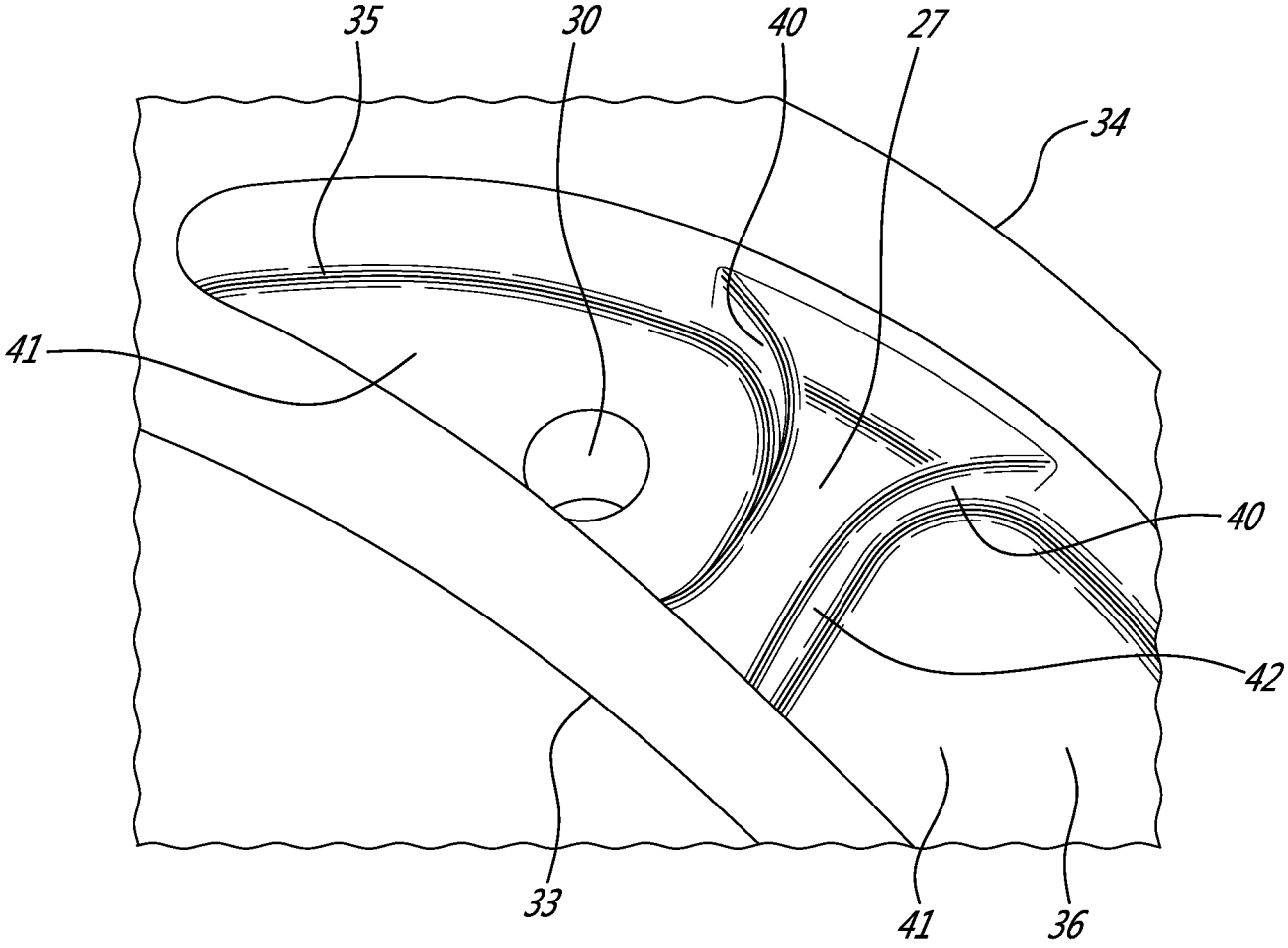
FIG. 5 is a detail view of the rib and a leading portion of the radially recessed tip pocket, where the rib has a rib height less than the wall height.
Figure 6:
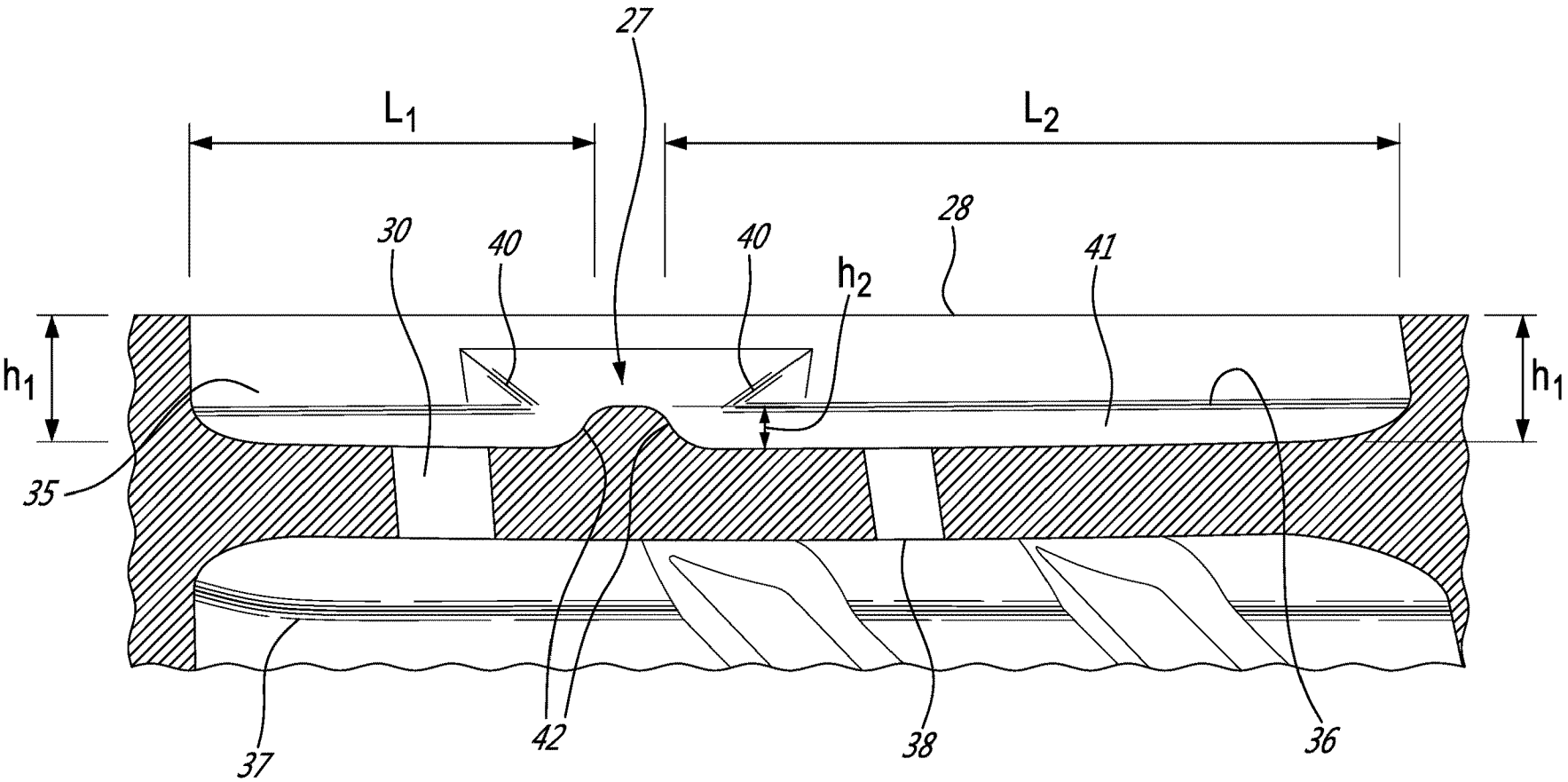
FIG. 6 is a radial sectional view through the rib and tip pocket along arcuate section line 6-6 of FIG. 4.

FIGS. 4-6 show a turbine blade tip having a partial height rib 27. A peripheral blade tip wall 28 surrounds a radially recessed tip pocket 29. As best seen in FIG. 6, the peripheral blade tip wall 28 has a wall height "$h_1$" and the rib 27 has a rib height "$h_2$" which is less than the wall height "$h_1$". A single rib 27 or multiple ribs 27 can be located to reinforce the peripheral blade tip wall 28 without significantly impeding cooling air flow. Cooling air exhausted through a leading cooling air exhaust hole 30 can cascade downstream over the rib 27.

Referring to FIGS. 4 and 5, the peripheral blade tip wall 28 has a leading edge 31, a trailing edge 32, a pressure side wall 33 and a suction side wall 34. The rib 27 extends between the pressure side wall 33 and the suction side wall 34. The rib 27 defines a leading portion 35 and a trailing portion 36 of the radially recessed tip pocket 29. The leading portion 35 of the radially recessed tip pocket 29 may include the leading cooling air exhaust hole 30 in communication with an internal cooling channel 37 (see FIG. 6) of the turbine blade. The trailing portion 36 of the radially recessed tip pocket 29 may include a trailing cooling air exhaust hole 38 in communication with the internal cooling channel 37 of the turbine blade.

As seen in FIG. 4, to distribute stress, avoid stress concentration and reduce gas flow turbulence, the rib 27 can arcuately merge with the pressure side wall 33 with fillets 39 on both the leading and trailing sides of the rib 27. Likewise as best seen in FIG. 5, the rib 27 also can arcuately merge with the suction side wall 34 with fillets 40. The lateral side walls of the rib 27 can arcuately merge with a tip pocket floor 41 with fillets 42.

As shown in the example of FIG. 6, the leading portion 35 may have a length dimension "$L_1$" less than a length dimension "$L_2$" of the trailing portion 36. As indicated in FIG. 4, an airfoil cross-section of the radially recessed tip pocket 29 has a width dimension (perpendicular to the length dimension) defined between the pressure side wall 33 and the suction side wall 34, and the rib 27 may be disposed at a point of maximum width. Alternatively, multiple ribs 27 may be spaced apart along the length of the radially recessed tip pocket 29 between the leading edge 31 and trailing edge 32 to structurally support the pressure side wall 33 and suction side wall 34 at various locations. The height "$h_2$" of the rib 27 is less than the height "$h_1$" of the radially recessed tip pocket 29, thereby allowing cooling air flow from the leading cooling air exhaust hole 30 to flow downstream over the rib 27 and to continue cooling of the blade tip.

The durability of the airfoil blade tip (including the peripheral blade tip wall) is structurally reinforced by the rib without any change to the external airfoil geometry and with a negligible weight increase. The rib or multiple ribs can add stiffness to the airfoil blade tip and in particular to the peripheral blade tip wall 28 at locations needing reinforcement without significant reduction in cooling capability. Accordingly the thermo-mechanical fatigue life of the airfoil may be addressed by addition of a partial height rib 27 in accordance with the example described above and shown in the drawings.

The above description is meant to be exemplary only, and one skilled in the relevant arts will recognize that changes may be made to the embodiments described without departing from the present description. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A turbine blade comprising:

an airfoil having a root and a tip, the tip having a peripheral blade tip wall surrounding a radially recessed tip pocket, the peripheral blade tip wall having: a wall height; a leading edge; a trailing edge; a pressure side wall; and a suction side wall; and a single partial height rib extending between the pressure side wall and the suction side wall defining a leading portion and a trailing portion of the radially recessed tip pocket, the single partial height rib having a rib height less than the wall height across all a width of the radially recessed tip pocket between the pressure side wall and the suction side wall, the single partial height rib disposed at a point of maximum width of the radially recessed tip pocket to structurally reinforce the peripheral blade tip wall by distributing stress between the pressure side wall and the suction side wall, the single partial height rib arcuately merging with the pressure side wall and the suction side wall with fillets on both a leading and a trailing side of the single partial height rib.

2. The turbine blade according to claim 1 wherein the leading portion of the radially recessed tip pocket includes a leading cooling air exhaust hole in communication with an internal cooling channel of the turbine blade.

3. The turbine blade according to claim 2 wherein the trailing portion of the radially recessed tip pocket includes a trailing cooling air exhaust hole in communication with the internal cooling channel of the turbine blade.

4. The turbine blade according to claim 1 wherein the single partial height rib arcuately merges with a tip pocket floor with fillets.

5. The turbine blade according to claim 1 wherein the leading portion has a length dimension less than a length dimension of the trailing portion.

6. A gas turbine engine comprising:

a turbine including a plurality of turbine blades, at least one of the plurality of turbine blades having a peripheral blade tip wall surrounding a radially recessed tip pocket, the peripheral blade tip wall having: a wall height; a leading edge; a trailing edge; a pressure side wall; and a suction side wall; and a single partial height rib extending between the pressure side wall and the suction side wall defining a leading portion and a trailing portion of the radially recessed tip pocket, the single partial height rib having a rib height less than the wall height across all a width of the radially recessed tip pocket between the pressure side wall and the suction side wall, the single partial height rib disposed at a point of maximum width of the radially recessed tip pocket to structurally reinforce the peripheral blade tip wall by distributing stress between the pressure side wall and the suction side wall, the single partial height rib arcuately merging with the pressure side wall and the suction side wall with fillets on both a leading and a trailing side of the single partial height rib.

7. The gas turbine engine according to claim 6 wherein the leading portion of the radially recessed tip pocket includes a leading cooling air exhaust hole in communication with an internal cooling channel of the turbine blade.

8. The gas turbine engine according to claim 7 wherein the trailing portion of the radially recessed tip pocket includes a trailing cooling air exhaust hole in communication with the internal cooling channel of the turbine blade.

9. The gas turbine engine according to claim 6 wherein the single partial height rib arcuately merges with a tip pocket floor with fillets.

10. The gas turbine engine according to claim 6 wherein the leading portion has a length dimension less than a length dimension of the trailing portion.

* * * * *